US005371442A

United States Patent [19]

Siems

[11] Patent Number: 5,371,442

[45] Date of Patent: Dec. 6, 1994

[54] REMOTE BALLAST CIRCUIT ASSEMBLY

[76] Inventor: Steven L. Siems, 1491 SW. 21st Ave., Ft. Lauderdale, Fla. 33314

[21] Appl. No.: 119

[22] Filed: Jan. 4, 1993

[51] Int. Cl.[5] ..... H05B 37/00

[52] U.S. Cl. ..... 315/244; 315/239; 315/227 R; 315/254

[58] Field of Search ..... 361/674, 377; 174/DIG. 2; 315/244, 239, 227 R, 228, 254, 247

[56] References Cited

U.S. PATENT DOCUMENTS

| | | | |
|---|---|---|---|
| 3,167,688 | 1/1965 | Hein | 361/674 |
| 3,317,796 | 5/1967 | Thompson | 361/674 |
| 3,919,459 | 11/1975 | Steenhoven | 174/DIG. 2 |
| 3,949,218 | 4/1976 | Hayward | 240/67 |
| 4,190,881 | 2/1980 | Drost et al. | 362/250 |
| 4,220,981 | 9/1980 | Koether | 362/61 |
| 4,393,435 | 7/1983 | Petrina | 361/377 |
| 4,878,160 | 10/1989 | Reneau et al. | 362/269 |
| 5,079,485 | 1/1992 | Hasemann et al. | 315/324 |

*Primary Examiner*—Benny Lee
*Assistant Examiner*—Haissa Philogene
*Attorney, Agent, or Firm*—Oltman and Flynn

[57] ABSTRACT

According to the invention there is provided a remote ballast circuit assembly comprising at least one ballast circuit; a housing having a top panel, an optional perforated bottom panel, two lateral side panels and a back panel, the panels defining a housing interior; the interior being divided into an upper chamber and a lower chamber, the upper chamber having exterior vent openings; at least one ballast coil in the ballast circuit disposed in the upper chamber; at least one resonating capacitor connected with the ballast coil disposed in the lower chamber; primary power connecting means for connecting primary power to the ballast circuit; and load connecting means for connecting a load to the ballast circuit. According to a further feature, the remote ballast circuit assembly according to the invention includes a hinged door panel hingedly attached to the housing for providing access to the housing interior. The remote ballast circuit assembly may further include a perforated transverse partition with a plurality of vent opening for admitting air flow from the lower chamber to the upper chamber, and further vent openings in the bottom panel for providing cooling air flow through the bottom panel, via the lower chamber, through the vent openings in the optional perforated transverse partition, and through the exterior vent openings via the upper chamber.

13 Claims, 4 Drawing Sheets

REMOTE BALLAST CIRCUIT ASSEMBLY

The invention relates to a remote ballast circuit assembly for electric arc-discharge type luminaries, and more particularly to such a remote ballast circuit assembly for high intensity luminaries composed of clustered light elements.

BACKGROUND AND PRIOR ART

It is well known to form high intensity luminaries formed of clustered high intensity electric arc light elements, for illuminating sports arenas, large traffic intersections, parking areas and so forth.

Usually such luminaries are mounted on crossarms on top of tall light poles so that the light can be distributed over large areas. U.S. Pat. No. 4,190,881 shows such a crossarm-mounted assembly of light elements all connected to an assembly of ballast coils with their associated supporting elements.

The luminaries according to the known art has the drawback that the ballast circuits and associated components are installed at the top of the light pole and, therefore, whenever service is required a service person must climb up the pole or be hoisted, usually by means of a so-called "cherry-picker" with a hydraulically operated basket lifting the service person to the top of the pole. This is a cumbersome and expensive procedure because the "cherry-picker" is normally mounted on a large truck, and most frequently service problems are related to the ballast circuits required for each of the light elements.

It is accordingly a primary object of the instant invention to provide a ballast assembly that is installed away from the crossarm-mounted luminaries, preferably near ground level, for more convenient serviceability.

It is a further object of the invention to provide a ballast assembly that is arranged such that the ballast components have better cooling, thereby assuring longer life and less frequent servicing.

Further objects and advantages of this invention will be apparent from the following detailed description of a presently preferred embodiment which is illustrated schematically in the accompanying drawings.

SUMMARY OF THE INVENTION

According to the invention there is provided a remote ballast circuit assembly comprising at least one ballast circuit; a housing having a top panel, a perforated bottom panel, two lateral side panels and a back panel, the panels defining a housing interior; an optional perforated transverse partition dividing the interior into an upper chamber and a lower chamber, the upper chamber having exterior vent openings; at least one ballast coil in the ballast circuit disposed in the upper chamber; at least one resonating capacitor connected with the ballast coil disposed in the lower chamber; primary power connecting means for connecting primary power to the ballast circuit; and load connecting means for connecting a load to the ballast circuit.

According to a further feature, the remote ballast circuit assembly according to the invention includes a hinged door panel hingedly attached to the housing for providing access to the housing interior.

The remote ballast circuit assembly further includes in the optional perforated transverse partition a plurality of vent openings for admitting air flow from the lower chamber to the upper chamber, and further vent openings in the bottom panel for providing cooling air flow through the bottom panel, via the lower chamber, through the vent openings in the perforated transverse partition, and through the exterior vent openings via the upper chamber.

According to another feature, the remote ballast circuit assembly includes in the lower chamber at least one ballast circuit current limiting means in each ballast circuit in series connection with the ballast coil and the primary power connecting means for limiting current in the ballast coil to a safe value.

The remote ballast circuit assembly can further include in the primary power connecting means at least two primary hot conductors, and in the current limiting means a respective circuit breaker in each of the primary hot conductors, and additionally in each ballast circuit a two-pole knife switch, each pole being connected in series with a respective one of the hot conductors.

According to still another feature each ballast circuit includes a fuse in series with each of the hot conductors.

The remote ballast circuit assembly according to the invention may have as the front panel a dead front panel, wherein the ballast coils are fixedly mounted on the dead front panel projecting rearwardly into the upper chamber, and a plurality of guide rails fixedly mounted on the back panel project in a forwardly into the upper chamber in alignment with the ballast coils for slidably receiving and supporting the ballast coils in their inserted position.

The remote ballast circuit assembly further includes internal wiring means for interconnecting the hot conductors, the ballast coil, the resonating capacitor and the current limiting means, and at least one terminal block for supporting the internal wiring.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DESCRIPTION OF THE PREFERRED EMBODIMENTS

Figure 1:
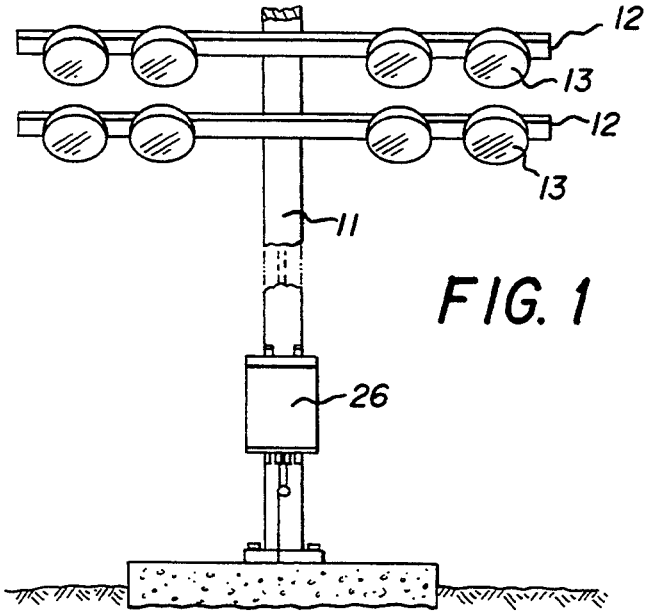
FIG. 1 is an elevational view of the invention showing it mounted on a pole for crossarm-mounted luminaries.
Figure 3:
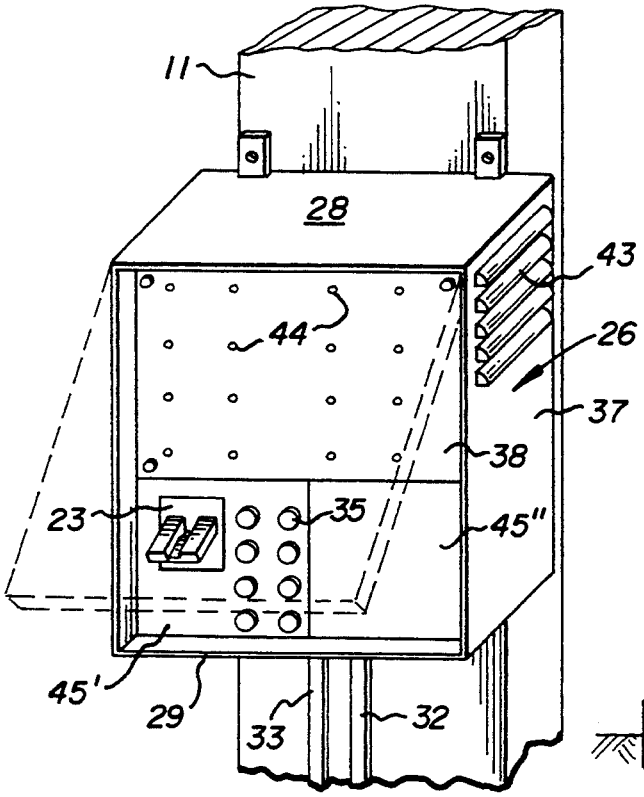
FIG. 3 is a perspective view of the invention showing the front panel and the pivotable front cover in phantom lines.
Figure 2:
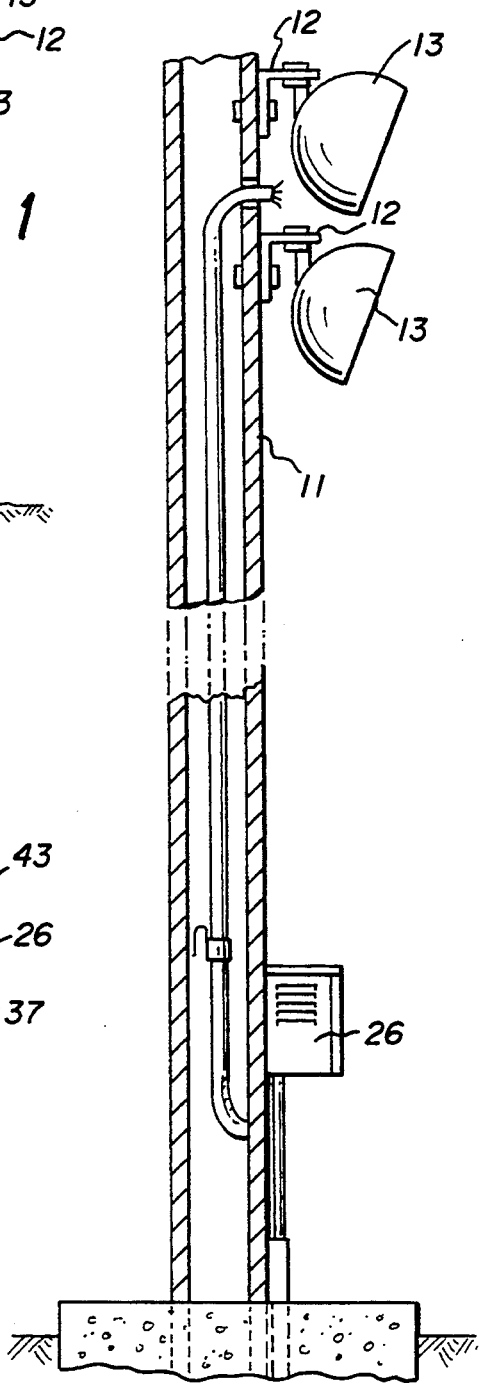
FIG. 2 is an elevational cross-sectional view of the invention showing it mounted on a post.

FIGS. 1, 2 and 3 show a mounting pole 11 for an arrangement of luminaries 12 composed of light elements 13 mounted on crossarms atop the pole 11. The light pole 11 can be constructed in various ways, e.g. as a tubular pole seen in FIGS. 1 and 2 or a solid pole as seen in FIG. 3. The pole can be made of metal, concrete, fiberglass or any other suitable material. The actual construction of the pole is immaterial to the instant invention. The light elements as contemplated are of the so-called arc-discharge type wherein an electric arc in a quartz tube provides intense light radiation. As is well known, such electric arc discharge light elements require for their operation a so-called ballast circuit in series with the light elements and the primary power source for stable operation.

Figure 10:
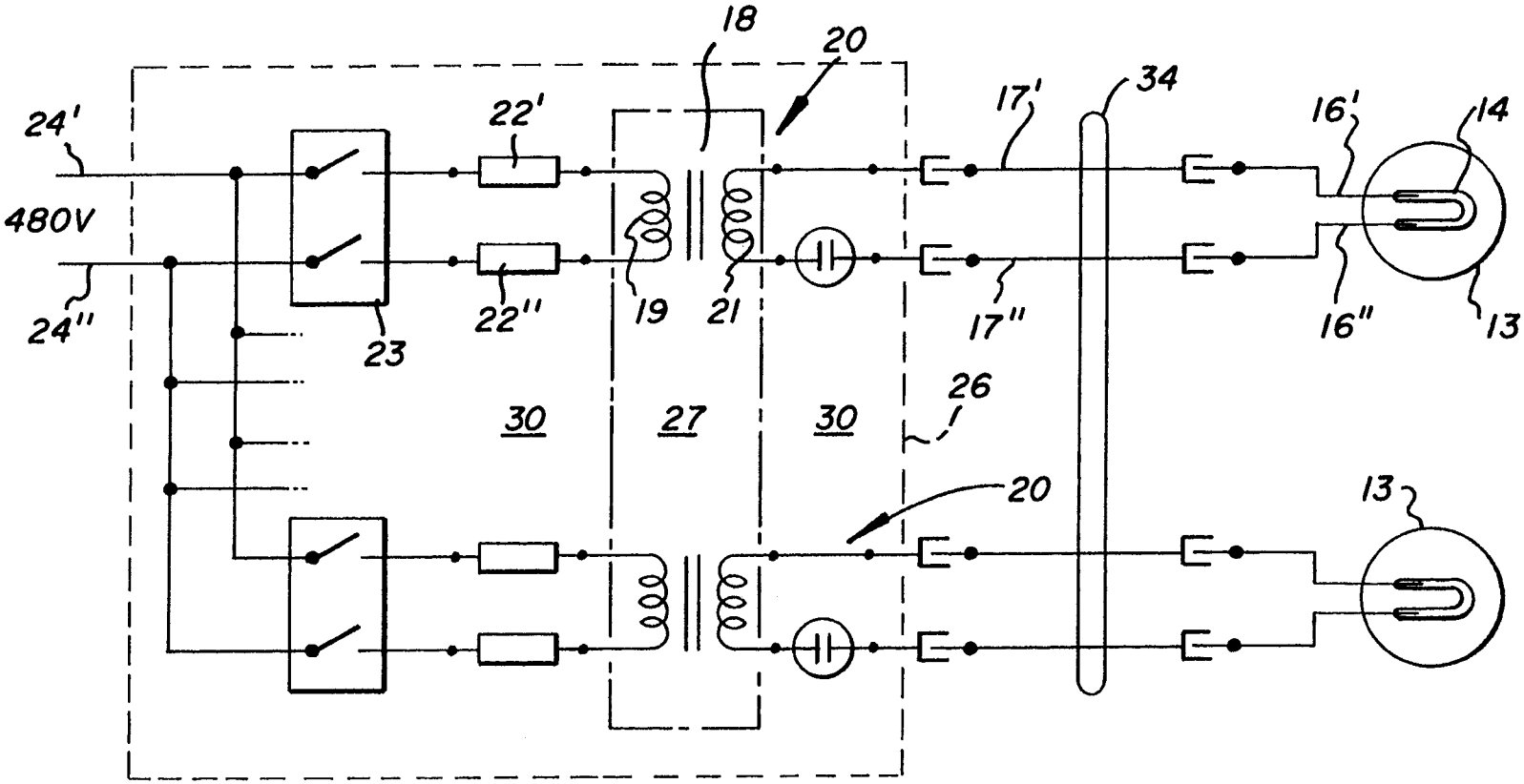
FIG. 10 is a circuit diagram.

FIG. 10 shows circuit details of a group of such electric arc discharge light elements with their respective ballast circuits, wherein the light emitter 14 has two poles 16' and 16" connected via load conductors 17', 17" in a load cable 34 with a plurality of ballast circuits 20, each composed of a ballast coil 18 connected with a resonating capacitor 22. The load coil 18 is essentially a specially constructed transformer with a primary winding 19 and a secondary winding 21. The secondary winding is connected to the light emitter in series with the resonating capacitor 22. The impedance of the secondary circuit is constructed such that stable operation of the electric arc is maintained. The primary winding 19 is connected via two optional current-limiting fuses 22',22", and an optional disconnect switch 23 with at least two voltage carrying, e.g. "hot" conductors 24',24" connected to a primary power source of e.g. 480 volts ac supply via a distribution block not shown in this figure. Instead of an optional disconnect switch 23 with fuses, it is also possible to form the disconnect switch as circuit breakers with ganged toggles so that a service person can switch off power to an entire ballast circuit whenever service is required. According to the invention, a housing 26 is provided which contains a plurality of the ballast circuits 20, as seen in FIG. 10. A problem with the conventional ballast circuits is that the ballast coils 18 generate a significant amount of heat, especially when a plurality of ballast circuits are packed together in a common housing 26. The resonating capacitors 22, on the other hand, are not very tolerant of elevated temperatures and deteriorate rapidly when operating temperatures rise above the limits specified by the manufacturer.

In order to attain longer operating life for the ballast circuit, there is provided in accordance with the inventive concept an arrangement of the housing 26 such that the ballast coils 18 are located in an upper chamber 27 of the housing 26 which is well ventilated. The upper chamber 27 is indicated by a stippled line box 27 in FIG. 10. The remaining components of the ballast circuit are disposed in a lower chamber 30 of the housing as seen in more details in FIGS. 4,5,6,7,8 and 9.

Figure 5:
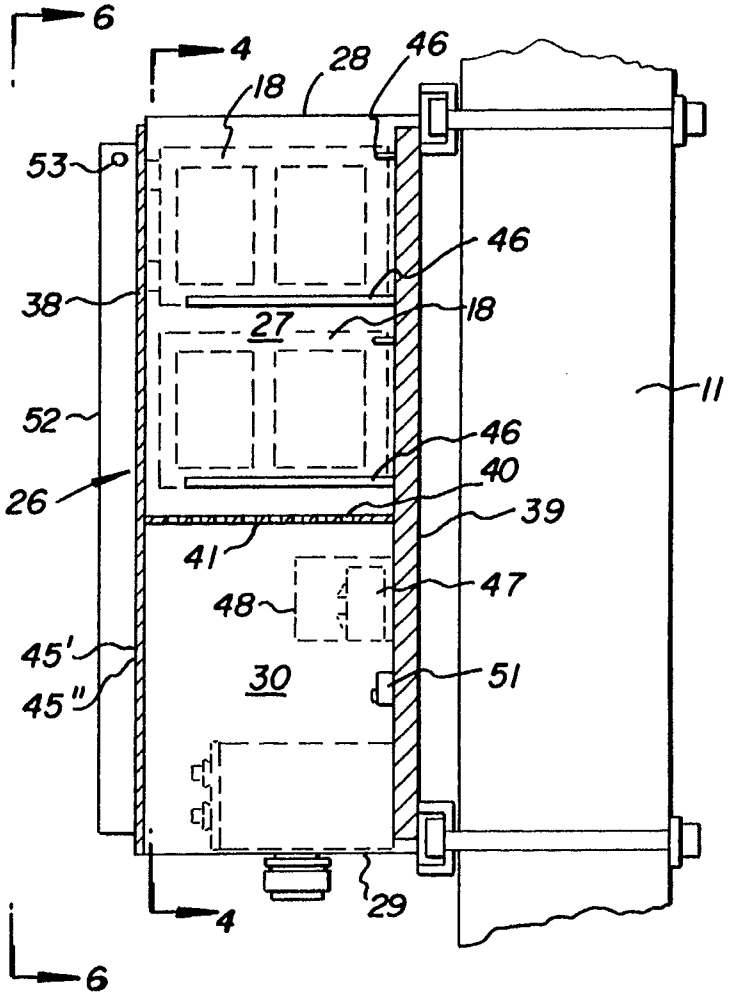
FIG. 5 is an elevational side view of the invention seen along the line 5—5 of FIG. 4 showing the interior construction.
Figure 4:
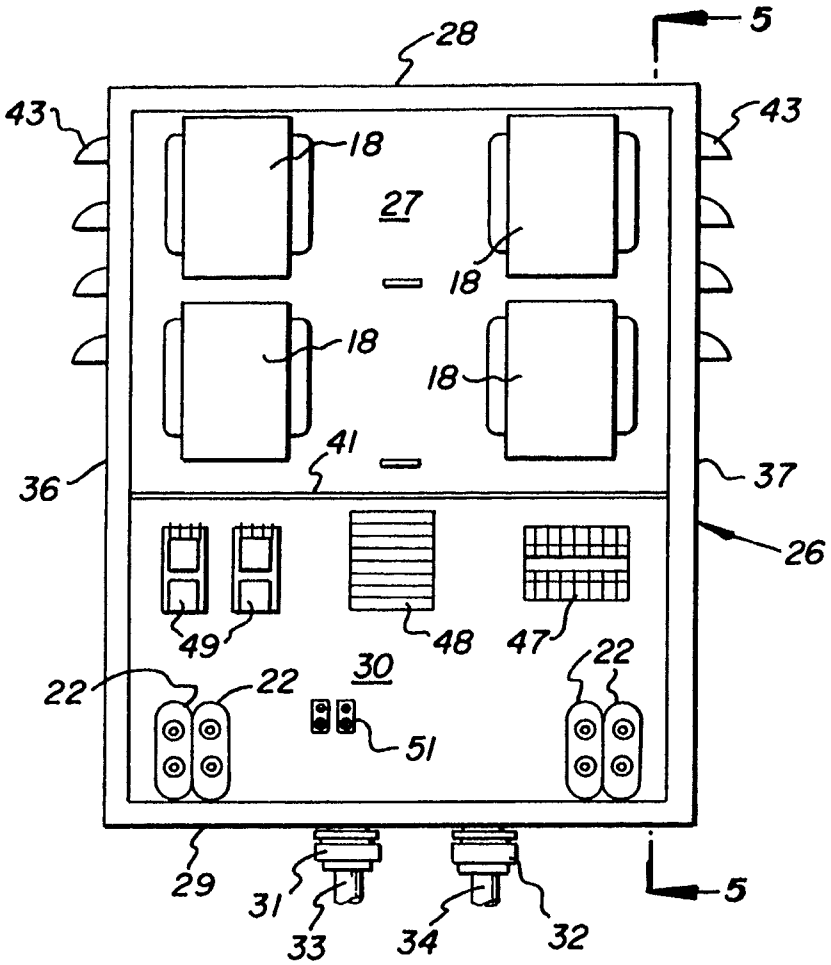
FIG. 4 is an elevational front view of the invention seen along the line 4—4 of FIG. 5 showing the interior construction.
Figure 9:
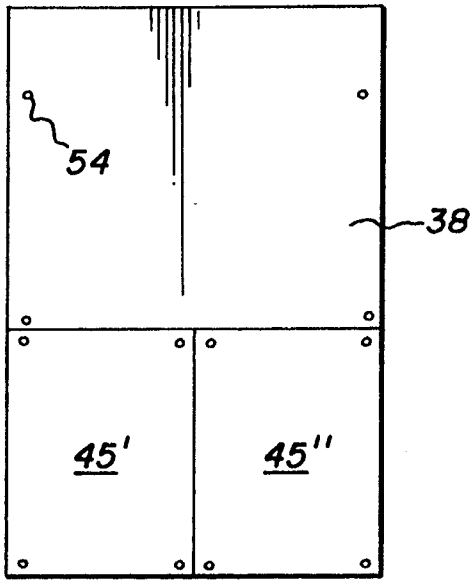
FIG. 9 is an elevational front view showing the upper dead front mounting plate and two lower front panels.

FIGS. 4 and 5 show respective front and side views of the housing 26, wherein the housing 26 is formed of a top panel 28, a bottom panel 29, the latter having adaptors 31, 32 mounted therein for entry of the primary service cable 33 and the load cable 34 containing the load conductors 17, ,and furthest of two lateral side panels 36,37, a noncurrent-conducting upper front panel known as a dead-front panel 38, two lower front panels 45', 45" as seen in FIGS. 3 and 9 and a back panel 39. In addition, an optional transverse perforated partition panel 41 divides the interior of the housing into the upper chamber 27 and the lower chamber 30.

The lower front panel 45' shows mounted thereon an optional on-off switch 23, and eight fuse holders 35 it in case externally accessible cartridge fuses are used instead or internally mounted fuses 48, as seen in FIG. 4. The upper part of the lateral side panels 36,37 have The upper part of the lateral side panels 36, 37 have louvered ventilation openings 43 formed therein, and/or additionally the top panel 28 may have outward extending overhangs 55 spaced above the top of lateral side panels 36,37 that allow further airflow from the upper chamber 27, so that cooling air is drawn in through ventilation openings 42 formed in the bottom panel 29 (FIG. 7) up through the lower chamber 30, cooling the resonating capacitors 22 in the lower chamber, and further up through the openings 40 in the optional perforated transverse partition 41 and through the upper chamber and out through the louvered ventilation openings 43 and/or through the overhang 55. The cooling air flow is driven by the "chimney effect" caused in the housing 26 by the heat generated by the ballast coils 18.

In accordance with an especially advantageous embodiment of the invention as shown in FIG. 4 and 50 thee dead-front panel 38 is arranged such that the ballast coils 18 are mounted on the dead-front panel, projecting backwardly into the upper chamber 27, mounted by screws 44 as seen in FIG. 3. The ballast coils 18 can further be supported at their rear side by guide rails 46 (FIG. 5) mounted on the back panel 39, and projecting forwardly into the upper chamber for receiving the ballast coils aligned with the guide rails 46 when the dead front panel is placed in position in the housing 26.

The lower chamber 30 holds other components such as at least one terminal block 47 that serves to interconnect the various wires of the internal wiring interconnecting the various components such as fuse blocks 48 for holding the fuses 22',22", and power distribution blocks 49 that serve to terminate he hot power conductors 24',24" of the incoming power cable 33, and the internal wiring as shown in FIG. 10.

The details of the wiring interconnecting the various components described above are not shown in FIGS. 4 and 5 for the sake of clarity.

A set of terminals 51 mounted on the back panel 39 serve to terminate protective ground wiring as required by the National Electric Code.

A pivotable, i.e. hinged, door panel 52, seen in phantom lines in FIG. 3, and in full lines in FIG. 5, is provided to protect the upper and lower front panels 38, 45', 45" against the weather, and is attached to the upper part of the housing 26 by means of hinge pins 53.

Figure 8:
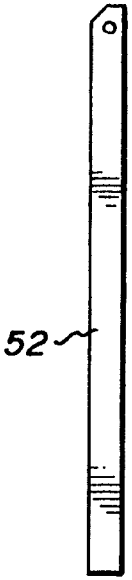
FIG. 8 is an elevational side view of the pivotable front door.
Figure 6:
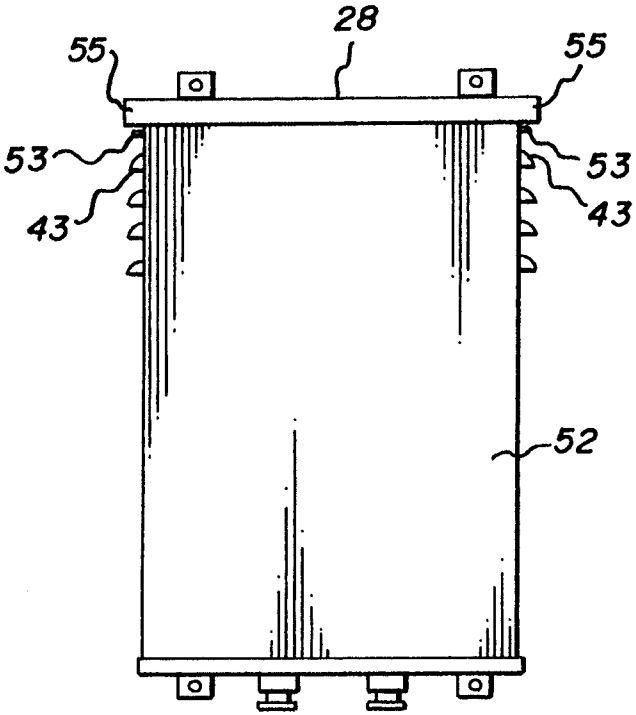
FIG. 6 is an elevational front view of the invention seen along the line 6—6 of FIG. 5.
Figure 7:
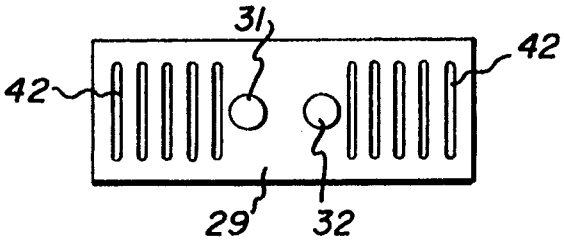
FIG. 7 is a plan view showing the bottom panel with ventilation openings.

The hinged door 52 is seen in a side view in FIG. 8. FIG. 9 shows the dead-front front panel 38, and holes 54 therein for attaching the panel 38 to the side panels 36,37.

I claim:

1. A remote ballast circuit assembly comprising at least one ballast circuit; a housing having a top panel, a bottom panel, two lateral side panels and a back panel, said panels defining a housing interior; said interior divided into an upper chamber and a lower chamber by substantially horizontal partition means comprising air passage means, said lower chamber comprising air admitting means for admitting air into said housing, and said upper chamber comprising air release means for releasing air from said housing, for providing cooling air flow through said lower chamber and through said upper chamber; a ballast coil in said ballast circuit disposed in said upper chamber; at least one resonating capacitor connected with the ballast coil disposed in said lower chamber; primary power connecting means for connecting primary power to said ballast circuit; and load connecting means for connecting a load to said ballast circuit, wherein said air release means comprises a plurality of upper vent openings in each of said lateral side panels communicating with said upper chamber, and wherein said air admitting means comprises a plurality of vent openings in said bottom panel, via said lower chamber, and through said upper vent openings via said upper chamber.

2. A remote ballast circuit assembly comprising at least one ballast circuit; a housing having a top panel, a bottom panel, two lateral side panels and a back panel, said panels defining a housing interior; said interior divided into an upper chamber and a lower chamber by substantially horizontal partition means comprising air passage means; a ballast coil in said ballast circuit disposed in said upper chamber; at least one resonating capacitor connected with the ballast coil disposed in said lower chamber; primary power connecting means for connecting primary power to said ballast circuit; load connecting means for connecting a load to said ballast circuit; and two extensions on said top panel overhanging and spaced above said lateral side panels for providing vent openings from said upper chamber.

3. A remote ballast circuit assembly according to claims 1 or 2, including in said housing a hinged door panel hingedly attached to said housing for providing access to said housing interior.

4. A remote ballast circuit assembly according to claims 1 or 2, wherein at least one said ballast circuit comprises current limiting means in series with said ballast coil and said primary power connecting means and contained within said lower chamber, for limiting current in said ballast coil to a safe value.

5. A remote ballast circuit assembly according to claim 4, including in said primary power connecting means two primary hot conductors, and including in said current limiting means a respective circuit breaker in series with each of said primary hot conductors.

6. A remote ballast assembly according to claim 4, including in each ballast circuit a two-pole knife switch, each pole being connected in series with a respective one of said hot conductors.

7. A remote ballast circuit assembly according to claim 6, including in each ballast circuit a fuse in series with each of said hot conductors.

8. A remote ballast circuit assembly according to claims 1 or 2, wherein said front panel is a noncurrent-conducting front panel, wherein said ballast coils are fixedly mounted on said noncurrent-conducting front panel projecting rearwardly into said upper chamber.

9. A remote ballast circuit assembly according to claim 8, including a plurality of guide rails fixedly mounted on said back panel and projecting forwardly into said upper chamber in alignment with said ballast coils for slidably receiving and supporting said ballast coils in their inserted position.

10. A remote ballast circuit assembly according to claim 5, including in said remote ballast assembly internal wiring means for interconnecting said hot conductors, said ballast coil, said resonating capacitor and said current limiting means.

11. A remote ballast circuit assembly according claim 10, including in said ballast assembly at least one terminal block for supporting said internal wiring.

12. A remote ballast circuit assembly according to claims 1 or 2, including a perforated transverse partition dividing said interior in an upper chamber and a lower chamber.

13. A remote ballast circuit assembly comprising at least one ballast circuit; a housing having a top panel, a bottom panel, two lateral side panels and a back panel, said panels defining a housing interior; said interior divided into an upper chamber and a lower chamber by substantially horizontal partition means comprising air passage means, said lower chamber comprising air admitting means for admitting air into said housing, and said upper chamber comprising air release means for releasing air from said housing, for providing cooling air flow through said lower chamber and through said upper chamber; a ballast coil in said ballast circuit disposed in said upper chamber; at least one resonating capacitor connected with the ballast coil disposed in said lower chamber; primary power connecting means for connecting primary power to said ballast circuit; load connecting means for connecting a load to said ballast circuit, and having on said top panel two extensions overhanging and spaced above said lateral side panels for providing vent openings from said upper chamber.

* * * * *